United States Patent [19]

Hühne

[11] Patent Number: 4,608,893

[45] Date of Patent: Sep. 2, 1986

[54] CUTTING APPARATUS FOR PLASTIC FOAM SOLIDS OR THE LIKE

[75] Inventor: Siegmar Hühne, Wesel, Fed. Rep. of Germany

[73] Assignee: Munchow und Huhne Maschinenbaugesellschaft mbH, Duisburg, Fed. Rep. of Germany

[21] Appl. No.: 692,038

[22] Filed: Jan. 16, 1985

[30] Foreign Application Priority Data

Jan. 20, 1984 [DE] Fed. Rep. of Germany ..... 3401910
Feb. 15, 1984 [DE] Fed. Rep. of Germany ..... 3405252

[51] Int. Cl.[4] ..... B26D 7/10; B26D 1/547

[52] U.S. Cl. ..... 83/171; 83/651.1; 83/751; 83/870

[58] Field of Search ..... 83/171, 651.1, 751, 83/776, 779, 870

[56] References Cited

U.S. PATENT DOCUMENTS

| | | | |
|---|---|---|---|
| 2,430,160 | 11/1947 | Criner | 83/751 |
| 2,479,908 | 8/1949 | Criner | 83/751 |
| 4,018,116 | 4/1977 | Treffner et al. | 83/870 |
| 4,222,299 | 9/1980 | Treffner et al. | 83/171 |

*Primary Examiner*—Donald R. Schran
*Attorney, Agent, or Firm*—Karl F. Ross; Herbert Dubno

[57] ABSTRACT

A cutting apparatus for plastic foam solids or the like which comprises a cutting wire system having a plurality of cutting wires attached substantially perpendicularly between two substantially parallel supporting rods spaced from each other so that a piece of plastic foam solid to be cut can be passed through the cutting wires between the supporting rods, and an oscillating drive engaged with the supporting rods so as to oscillate rotatably the supporting rods in opposing rotational directions and therefore to oscillate the wires to and fro lengthwise. The cutting wires are spaced from each other in either of two cutting wire positions lengthwise along the supporting rods. The cutting wires are attached eccentrically to the outer periphery of the supporting rods, each of the cutting wires which are each in a different one of the cutting wire positions lying in planes parallel to the supporting rods and each of the cutting wires in the same cutting wire position lying in the same plane. Each of the cutting wires in the different cutting wire positions is guided to and attached to opposite outer peripheral sides of each of the supporting rods so that the planes formed by the cutting wires of each of the different cutting wire positions cross each other at an acute angle. Preferably the cutting wires are heatable electrically and attached to the supporting rods by way of coil springs.

7 Claims, 4 Drawing Figures

CUTTING APPARATUS FOR PLASTIC FOAM SOLIDS OR THE LIKE

CROSS REFERENCE TO RELATED APPLICATION

This application is related to the commonly assigned copending application Ser. No. 692,642, filed Jan. 17, 1985, based upon German application No. P 34 01 869.7 filed Jan. 20, 1984.

FIELD OF THE INVENTION

My present invention relates to an apparatus for cutting bodies and, more particularly, to a hot-wire cutter or slab slicer for synthetic resin foam bodies and the like.

BACKGROUND OF THE INVENTION

A cutting apparatus for slicing plastic foam solids or the like (hereinafter referred to as a foam body or block) can comprise a cutting wire system having a plurality of cutting wires spanning two parallel supporting rods and attached substantially perpendicularly to them so that a foam body to be cut into slabs by parallel cuts can be passed through the array of cutting wires between the supporting rods.

An oscillating drive is operatively connected to the supporting rods so as to angularly oscillate the supporting rods in opposing rotational directions and therefore to reciprocate the wires to and fro lengthwise.

The cutting wires can be attached eccentrically to the outer peripheries of the supporting rods and are energized with an electric current so that resistive heating is generated and enables each wire to cleanly slice through the body.

In the apparatus of this type described in U.S. Pat. No. 4,222,299, the planes of both cutting wire positions are coincident, i.e. all the cutting wires lie substantially in a single plane.

The ends of the cutting wires of both sets of oppositely moving cutting wires are attached to both supporting rods on the same outer peripheral side, and, of course, at one end by a coil spring and the other end by an inextensible attachment means. The coil springs of one wire set are associated with a first supporting rod and the inextensible attachment means thereof with the second supporting rod. The inextensible attachment means of the other set are affixed to the first rod and the coil springs of this set are attached to the second rod. The supporting rods are angularly oscillated in opposing senses to reciprocate the sets of wires in opposite directions with periodic variations of the respective coil spring lengths.

This prevents imbalanced forces and moments from developing which would affect the plastic foam body.

Advantageously in this prior art construction, cost is minimal because collectively only two oscillating supporting rods and a correspondingly simple oscillating drive are required.

In practice, however, there is the disadvantage that the coil springs produce significant tension in the cutting wires due to the periodic length variation of the wires during operation which is particularly a problem for the eyelet attachments at the ends of the wire which are comparatively easily broken or worn out.

U.S. Pat. No. 4,018,116 also describes an apparatus for cutting a plastic foam solid or the like comprising a cutting wire system having two cutting wire sets, wherein the cutting wires of one set move back and forth opposite to the cutting wires of the other set. Here the cutting wires are attached at their ends to two supporting rods which are angularly oscillated about their longitudinal axes in the same sense of rotation.

Both these supporting rods are associated with the cutting wires of one cutting wire set, while for the cutting wires of the other cutting wire set, two additional supporting rods are required and are angularly oscillated in the same rotational sense, which is however opposite to the sense of angular oscillation of the first pair of supporting rods mentioned.

OBJECTS OF THE INVENTION

The principal object of my present invention is to provide an improved hot-wire cutting apparatus for a plastic foam body having two supporting rods in which the cutting wires in the respective cutting wire sets move to and fro lengthwise in directions opposite to each other but which eliminates largely the periodic length variation of the cutting wires and thus excessive expansion and contraction of the coiled springs associated therewith so as to reduce breakage and wear.

It is another object of this invention to provide an improved cutting apparatus for a plastic foam body having a plurality of cutting wires attached to two supporting rods which is of simple construction and easily operated but not easily broken and worn out.

Yet another object is to provide an improved slicing machine which avoids excessive stress upon the wires but also balances the forces generated by the oppositely moving sets of wires.

SUMMARY OF THE INVENTION

These objects and others which will become apparent hereinafter are attained in accordance with the invention in a hot-wire slab slicing or cutting apparatus for plastic foam bodies or the like comprising a cutting wire system having a plurality of cutting wires attached substantially perpendicularly between two substantially parallel supporting rods spaced from each other so that the plastic foam body to be cut can be passed through the array of cutting wires between the supporting rods, and an oscillating drive operatively connected with the supporting rods so as to angularly oscillate the supporting rods in opposing rotational directions or senses and therefore to reciprocate the cutting wires to and fro lengthwise, the cutting wires of the two sets lying in a common plane.

According to the invention the planes formed by the sets or array of mutually parallel codirectionally moving cutting wires intersect between the supporting rods at an acute angle, the cutting wires of the two planes being attached to opposite outer peripheral sides of each of the supporting rods from that to which the other wires are attached, i.e. the wire of one set is attached to a front side of a first rod and a rear side of a second rod with respect to the direction of propagation of the cut, while each wire of the other set is connected to the rear side of the first rod and to the front side of the second rod.

In the apparatus of the invention the cutting wires of both cutting wire planes are advantageously guided around and/or attached to the supporting rods so that the arrays form a figure-8 in projection on a plane perpendicular to the supporting rods.

The opposing movements of the cutting wires of both cutting wire positions are achieved because the ends of the cutting wires of the one cutting wire plane and the ends of the cutting wires of the other cutting wire plane are attached to opposite outer peripheral sides of each of the supporting rods and also each cutting wire of a given cutting wire position is attached to opposing outer peripheral sides of the two supporting rods so that the cutting wires of one cutting wire plane cross the cutting wires of the other cutting wire plane.

Since each of the supporting rods angularly oscillates in a rotational sense opposite to each other, periodic length variations of the cutting wires no longer occur.

Advantageously the oscillating drive comprises an eccentric drive engaged to an end of one of the supporting rods and having a belt coupling looped around both of the supporting rods so that the supporting rods are angularly oscillated in opposite rotational senses.

Also the cutting wire may be constructed having a flexible cable piece or portion at the ends of the cutting wire attached to the supporting rods in the preferred embodiment.

Additionally and optionally the wires may be heated electrically to improve the cutting. The cutting wires may be connected to the supporting rods by coil springs to absorb shocks, but because the supporting rods oscillate rotatably in opposite rotational directions to each other there are no substantial changes in wire length or spring length during operation and consequently no breakage or fatigue problems as in prior art apparatuses. The supporting rods are advantageously constructed from a core and two substantially equal supporting half-shells removably attached thereto.

BRIEF DESCRIPTION OF THE DRAWING

The above and other objects, features and advantages of the invention will become more readily apparent from the following description, reference being made to the accompanying highly diagrammatic drawing in which:

FIG. 1 is a side view of a preferred embodiment of the cutting apparatus of the invention for plastic foam bodies and the like;

SPECIFIC DESCRIPTION

Figure 1:
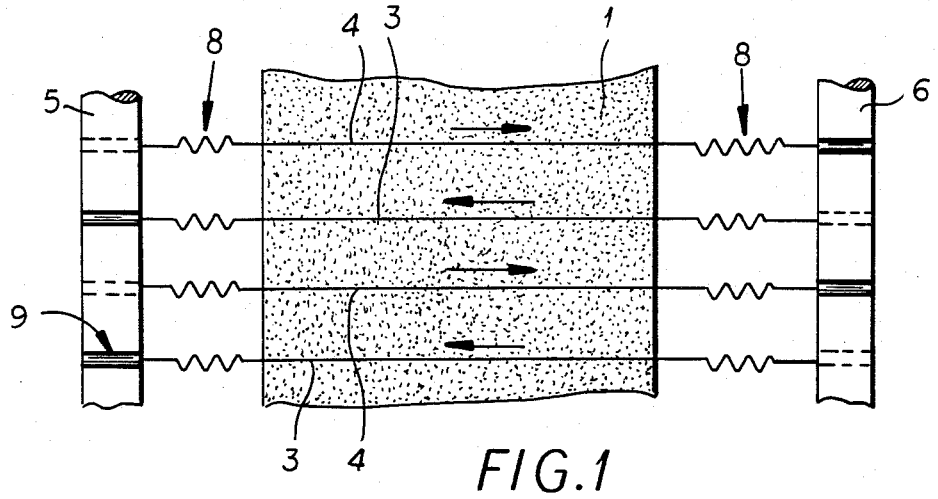

The apparatus shown in the drawing is used for cutting plastic foam solids 1, for example parallelepiped-shaped polystyrene foam bodies into plates or slabs and, of course, has a heated cutting wire system. The plastic foam solid 1 is fed through the cutting wire system on an unshown guide (e.g. a conveyor belt) perpendicularly to the plane of the drawing in FIG. 1 and in a direction indicated by the arrow 2 in FIG. 2.

The cutting wire assembly described below is preferably received in a U-shaped rod frame which is removably mounted in a U-shaped frame-support by the arrangement shown in the above mentioned copending application where the operation of the arrangement is also fully described.

The cutting wire system has a plurality of cutting wires 3 and 4. These cutting wires 3 and 4 are spaced from one another along supporting rods 5 and 6 as required for the cut plate or slab thickness. The supporting rods 5 and 6 have a spacing from each other which is greater than the width of the plastic foam solid body 1 and run parallel to each other as well as perpendicular to the cutting wires 3 and 4.

Figure 2:
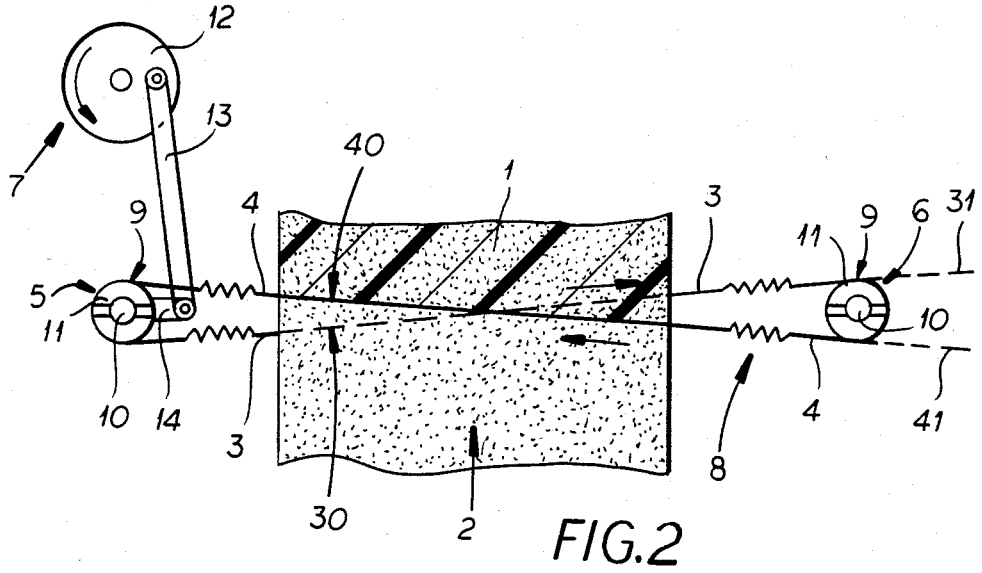
FIG. 2 is a diagrammatic top view (with a body shown in partial section) of the apparatus of FIG. 1.

As can be seen from FIG. 2 particularly, the cutting wires 3 and 4 are attached with their ends eccentric to both supporting rods 5 and 6. Moreover from a comparative study of both the figures, it can be seen that the cutting wires 3 and 4 are associated with one of two cutting wire planes 30 or 40.

Another arrangement using similar principles is possible in which say half of the cutting wires 3 lie in plane 30 and the balance in plane 40 while the cutting wires 4 similarly lie in plane 40 in that region where the wires 3 lie in plane 30 and the remaining wires 4 lie in plane 30. The dividing line between the halves lies centrally of the lengths of the supporting rods 5 and 6 so that the wires are disposed symmetrically of a line centrally through the rods.

With the aid of a piece engaged on the supporting rods 5 and 6 and an oscillating drive 7 which angularly oscillates supporting rods 5 and 6 about their longitudinal axes, the cutting wires 3 and 4 of both cutting wire arrays 30 and 40 are movable back and forth running counter to each other, that is, the cutting wire 3 always moves in a direction counter to cutting wire 4 of the other cutting wire plane 40 and vice versa.

From a comparative study of the figures one learns that the planes 31 and 41 of both cutting wire arrays 30 and 40 between the supporting rods 5 and 6, which are reciprocated counter to one another, intersect a small included angle which should be as small as possible under the given circumstances, so that the planes may be considered to approach a parallel orientation in which the planes would be coincident.

The first ends of cutting wires 3 of cutting wire position 30 are guided forward of the outer periphery of the left supporting rod 5 in FIG. 1 or behind the outer periphery of the left support rod in FIG. 2. On the other right supporting rod 6 the arrangement of the ends of the cutting wires 3 and 4 are correspondingly reversed, thus the ends of the cutting wires of the first mentioned cutting wire position 30 are guided behind in FIG. 1 and above in FIG. 2 the outer periphery of right supporting rod 6 and the ends of the second mentioned cutting wire position 40 are guided in front of in FIG. 1 and below in FIG. 2 the outer periphery of right supporting rod 6.

Together the metal cutting wires 3 and 4 are electrically heated by a source of electric current C (FIG. 3) connected by brushes 50 spring biased against the metal cores 10 of the rods.

So that the cutting wires 3 and 4 are held under tension, at least one end of cutting wires 3 or 4 is connected by-way-of a coil spring 8 with the supporting rods 5 or 6. Two helical springs 8 can be used at the respective ends of the cutting wires 3 or 4 although it is preferred that an inextensible attachment be provided at the end opposite that having a spring.

In any case the ends of the cutting wires 3 or 4 in tangency with the supporting rods 5 and 6 can be connected thereto by a flexible wire, rope or cable piece 9, which does not prevent the oscillatory take off and wind up of cutting wires 3 or 4 with respect to the supporting rods 5 or 6.

Figure 3:
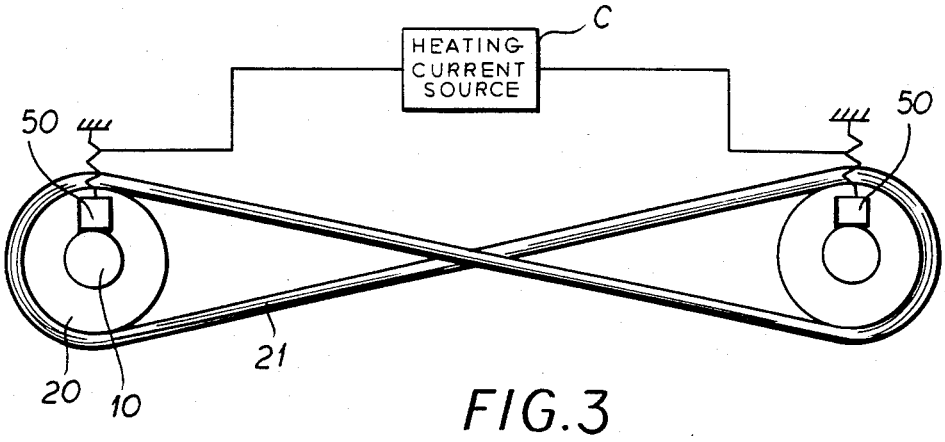
FIG. 3 is a diagram showing the reciprocal angular displacement system.
Figure 4:
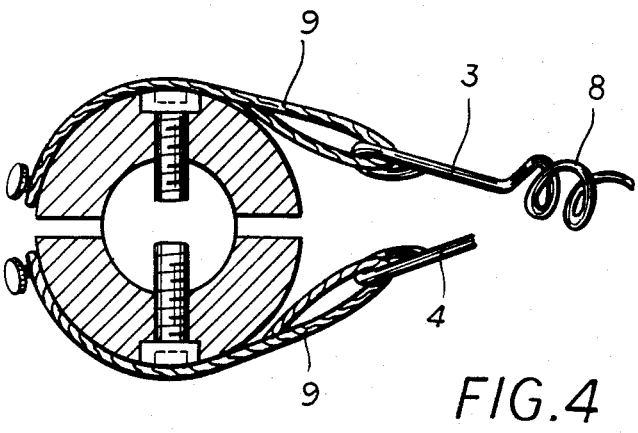
FIG. 4 is a detail section through one of the supporting rods.

The supporting rods 5 or 6 are each constructed from a respective core rod 10 and two supporting half-shells 11 bound thereto by, for example cementing, which, as seen in FIG. 2, without further effort is secure. As shown in FIG. 4, however, bolts can be used to enable the sets of wires to be readily removed. The oscillating drive 7 for both the supporting rods 5 or 6 is only indicated diagrammatically. It comprises an eccentric drive 12, whose connecting rod 13 is pivotally connected to a radical lever 14 at one end of a supporting rod 5. The other supporting rod 6 is coupled to supporting rod 5 by a belt 21 which is wound around sheaves 20 on the ends of the supporting rods 5 and 6 in the shape of a FIG. 8 (FIG. 3).

I claim:

1. In a slab-cutting apparatus having a cutting wire system in which a plurality of cutting wires are attached substantially perpendicularly to and span two substantially parallel supporting rods spaced from each other so that a body to be cut can be passed through said cutting wires between said supporting rods, and an oscillating drive is operatively connected with said supporting rods so as to angularly oscillate said supporting rods in opposite senses and reciprocate said wires, said wires lying in two cutting wire planes and being attached eccentrically to the outer peripheries of said supporting rods, the improvement wherein said planes intersect between said supporting rods at an acute angle and each of said cutting wires is attached one side of one of said rods and to an opposite side of the outer of said rods, each of said supporting rods comprises a core rod and two supporting half shells attached to said core rod.

2. The improvement defined in claim 1, further comprising means for electrically heating said cutting wires.

3. The improvement defined in claim 1 further comprising a pretensioned coil spring connecting one end of each of said wires to a respective one of said rods.

4. The improvement defined in claim 1, further comprising a flexible element tangentially connecting said cutting wires to said supporting rods.

5. The improvement defined in claim 4 wherein said flexible element is a wire cable.

6. The improvment defined in claim 4, wherein said flexible element is a rope.

7. The improvement defined in claim 1, wherein that said oscillating drive comprises an eccentric drive connected to an end of one of said supporting rods and a belt coupling both of said supporting rods so that said supporting rods angularly oscillate in opposite senses.

* * * * *